United States Patent [19]

Rieger

[11] Patent Number: 4,838,240

[45] Date of Patent: Jun. 13, 1989

[54] FIREPLACE GAS BURNER ASSEMBLY

[76] Inventor: Heinz H. Rieger, 17 Martin Road, Toronto, Ontario, Canada, M4S 2V1

[21] Appl. No.: 169,234

[22] Filed: Mar. 16, 1988

[30] Foreign Application Priority Data

Aug. 13, 1987 [CA] Canada ..... 544506

[51] Int. Cl.[4] ..... F24C 3/04

[52] U.S. Cl. ..... 126/92 R; 126/512; 431/125; 428/18

[58] Field of Search ..... 431/125, 350, 328, 354; 126/92 R, 127, 92 AC, 512; 428/15, 18

[56] References Cited

U.S. PATENT DOCUMENTS

| | | | |
|---|---|---|---|
| 613,015 | 10/1898 | Monroe | 431/125 |
| 697,941 | 4/1902 | Hewitt | 431/125 |
| 819,260 | 5/1906 | Whitney | 126/127 |
| 3,013,602 | 12/1961 | Heimerl | 431/328 |
| 3,042,109 | 7/1962 | Peterson | 431/125 |
| 3,362,395 | 1/1968 | Peterson | 126/127 X |
| 3,377,229 | 4/1968 | Bryan | 431/125 X |
| 3,385,651 | 5/1968 | Rasmussen et al. | 126/127 X |
| 3,543,741 | 12/1970 | Whitehead | 126/92 R |
| 3,671,175 | 6/1972 | Campbell | 126/92 R X |
| 3,696,801 | 10/1972 | Whitehead | 126/92 R |
| 3,760,790 | 9/1973 | Voges | 431/125 X |
| 3,947,229 | 3/1976 | Richter | 431/125 |
| 4,076,490 | 2/1978 | Hilker | 431/125 |
| 4,306,537 | 12/1981 | Mitchell | 126/92 AC |

FOREIGN PATENT DOCUMENTS

| | | | |
|---|---|---|---|
| 2179438 | 3/1987 | United Kingdom | 126/92 R |
| 2185100 | 7/1987 | United Kingdom | 126/92 AC |

*Primary Examiner*—Margaret A. Focarino
*Attorney, Agent, or Firm*—David W. Wong

[57] ABSTRACT

A gas burner assembly for a fireplace is shown. The assembly is operative to produce a flickering yellow flame pattern which closely resembles to that produced by a natural wood log fire, yet there is virtually no formation of carbon monoxide gas in the ignition. The assembly generally comprises four artificial logs arranged in a predetermined spaced relationship to a gas burner. The gas burner consists of a rectangular opened top casing having distribution means for emitting a gas and air mixture through its top. The artificial log comprises a flexible metal tube wrapped with a ceramic fibre blanked which is impregnated with a colloidal compound and thermally cured. The surface of the log is textured and painted to simulate the appearance of a natural wood log. Flame deflectors are provided either above or in the burner to baffle direct flame impingement on the logs so that the flames rise to a relatively high level above the logs to provide a full visibility of the flame in the fireplace.

11 Claims, 7 Drawing Sheets

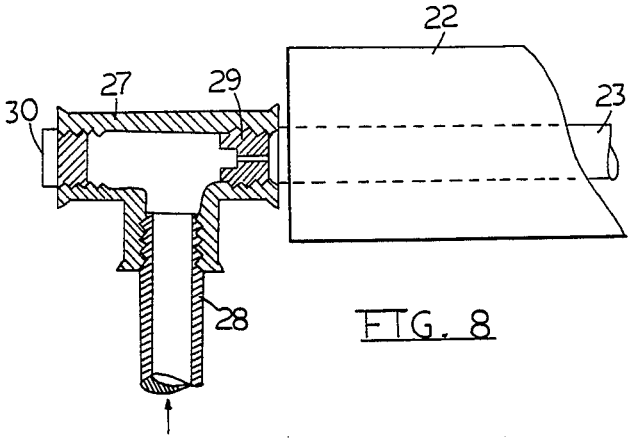
FIG. 8
FIG. 9
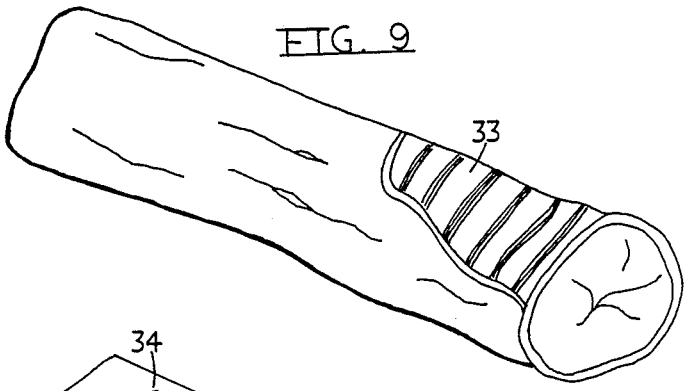
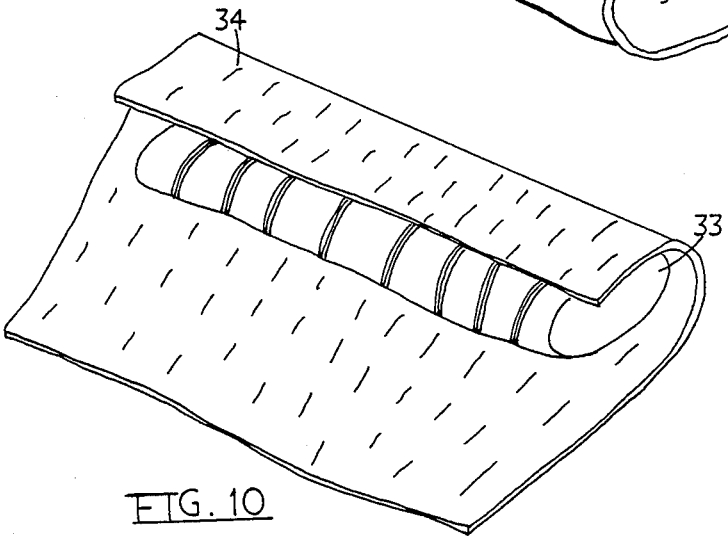
FIG. 10

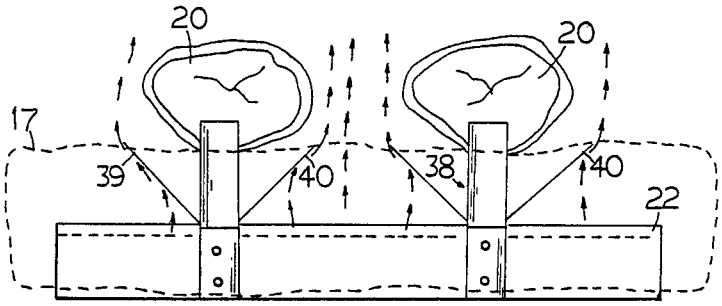
FIG. 15
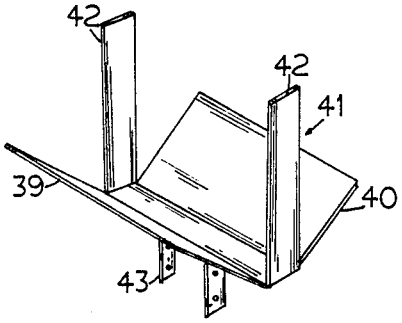
FIG. 16
FIG. 19
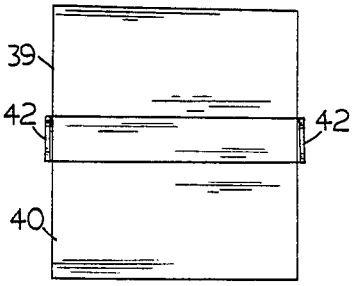
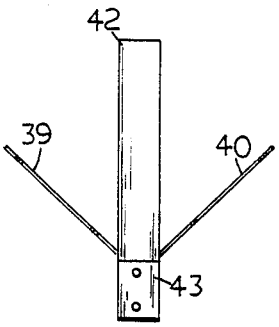
FIG. 17
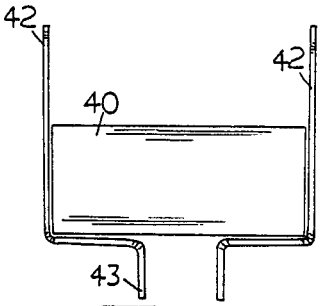
FIG. 18

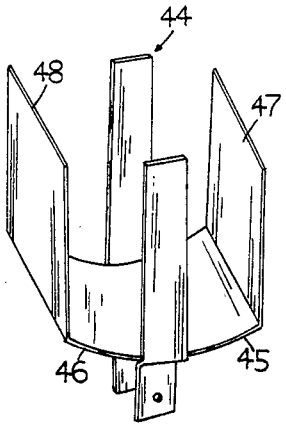
FIG. 20
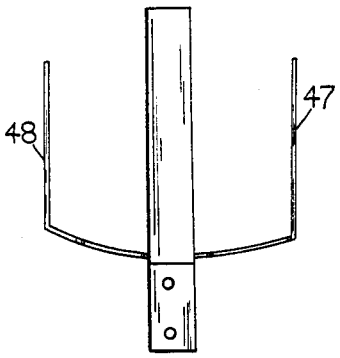
FIG. 21
FIG. 22
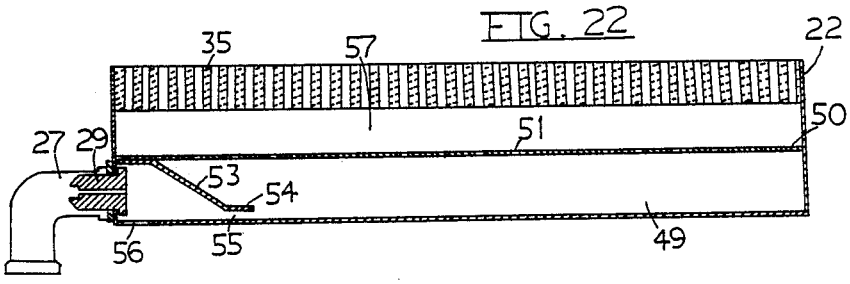
FIG. 23
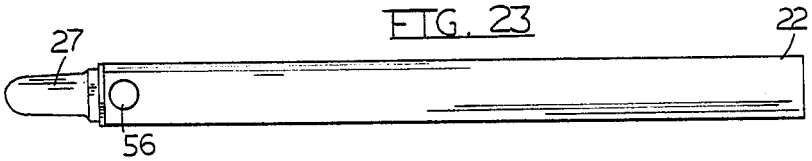
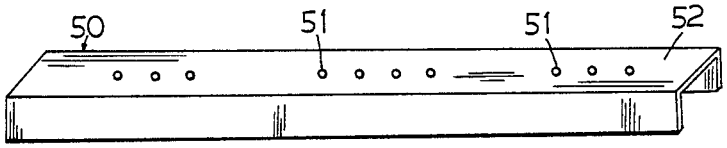
FIG. 24
FIG. 25
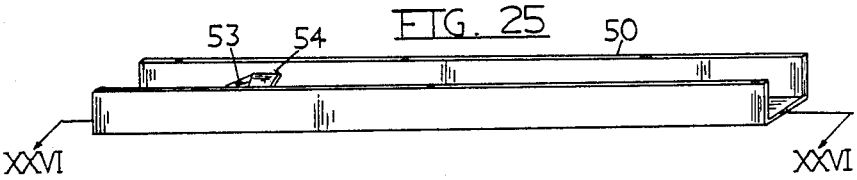

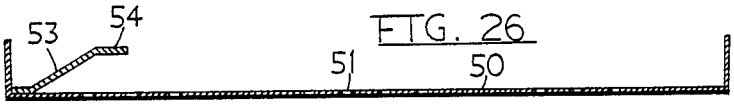
FIG. 26
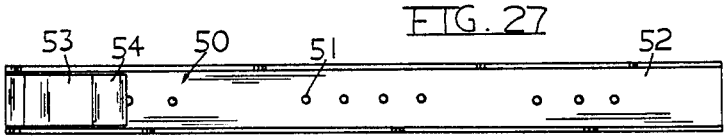
FIG. 27
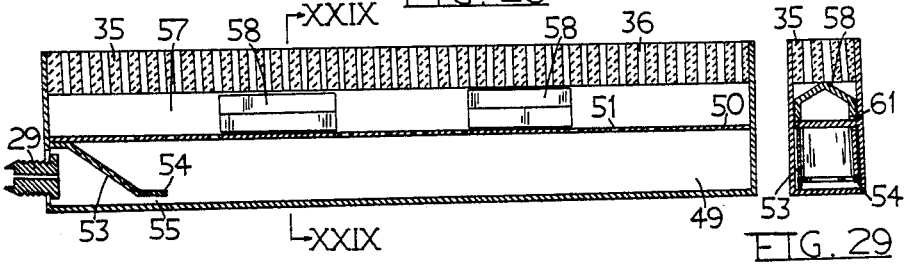
FIG. 28
FIG. 29
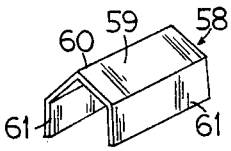
FIG. 30
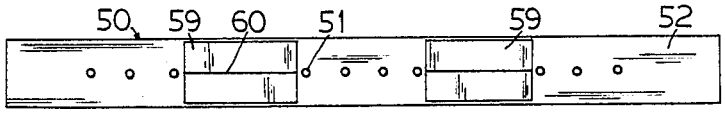
FIG. 31
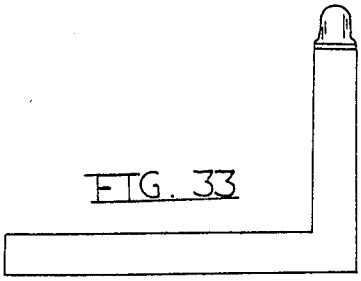
FIG. 33
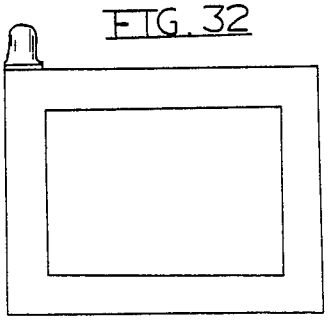
FIG. 32

FIREPLACE GAS BURNER ASSEMBLY

BACKGROUND OF THE INVENTION

This invention relates to fireplace gas burners, and more particularly to a gas burner assembly with associated artificial logs for providing a burning flame pattern similar to that produced by burning natural wood logs in the fireplace.

In gas fireplaces a gas burner can be provided for igniting the logs; and usually, permanent and reusable artificial logs are used so that it is not necessary to replenish the logs. A common drawback of such gas fireplace burner and artificial logs asembly is the lack of likeness of the flaming pattern to that of a natural wood log fire. An important and most desirable pattern of the natural wood log fire is the appearance of yellow flames flickering among the logs. Heretofore, assemblies of gas burner with artificial logs suffered the drawback of unable to produce such flickering yellow flames without the inherent formation of unacceptable level of harmful carbon monoxide gas. The production of carbon monoxide gas is, in many instances, further increased when the primary air shutter of such gas burners is erroneously set by the user.

Moreover, the artificial logs commonly are made of a refractory material such as concrete. Such concrete logs require considerable time to heat up, thus increasing impingement of the flames. Since the national standards of gas burners require that a sample of the ignited gas from the burner to be taken within three minutes from the start up, it has been generally experienced that only very hot (about 3500° F.) blue flames will meet such requirement for acceptable level of carbon monoxide gas in gas ignition.

OBJECTS OF THE INVENTION

The principal object of the present invention is to provide a gas burner assembly which is operative to produce a close simulation of the flaming pattern to that of a natural wood log fire.

Another object of the present invention is to provide a gas burner assembly operative with virtually no production of carbon monoxide gas.

Another object of the present invention is to provide a gas burner assembly which is easy to operate and is not subject to erroneous operation by the user.

It is yet another object of the present invention to provide artificial logs having characteristics of a fast heat up rate.

Other objects of the invention will appear in the following description and appended claims, reference being made to the accompanying drawings.

BRIEF DESCRIPTION OF THE DRAWINGS

FIG. 8 is a partial cut away enlarged view of the alternative T-shaped coupler to the gas burner.

FIG. 9 is a perspective view of the artificial log according to the present invention.

FIG. 10 is a perspective view of the assembly of the artificial log according to the present invention.

FIG. 15 is a perspective front elevation view of the fireplace gas burner assembly with the flame deflectors provided below the top logs.

FIG. 16 is a perspective front elevation view of the flame deflector.

FIG. 17 is a perspective end elevation view of the flame deflector.

FIG. 18 is a perspective side elevation view of the flame deflector.

FIG. 19 is a perspective top elevation view of the flame deflector.

FIG. 20 is a perspective front view of the alternative flame deflector having vertical panels.

FIG. 21 is a perspective end elevation view of the alternative flame deflector.

FIG. 22 is a front sectional view of the alternative gas burner according to the present invention.

FIG. 23 is a bottom elevation view of the alternative gas burner.

FIG. 24 is a perspective front elevation view of the differential cover in the alternative gas burner.

FIG. 25 is the upside down end elevation view of the differential cover.

FIG. 26 is a sectional view of the upside down view of the differential cover along line XXVI—XXVI of FIG. 25.

FIG. 27 is the bottom elevation view of the differential cover.

FIG. 28 is a partial sectional front eleveation view of the gas burner according to the present invention showing the incorporation of baffle inserts in the burner.

FIG. 29 is a sectional side elevation of the gas burner along line XXIX—XXIX in FIG. 28.

FIG. 30 is a perspective front elevation view of the baffle insert.

FIG. 31 is a top elevation view of the differential cover and baffle inserts.

FIG. 32 is a top elevation view of a gas burner having a rectangular configuration suitable for use in an opened fireplace having opened sides.

FIG. 33 is a top elevation view of a gas burner having an L-shaped configuration suitable for use in a corner fireplace.

DETAILED DESCRIPTION OF THE PREFERRED EMBODIMENTS

Figure 1:
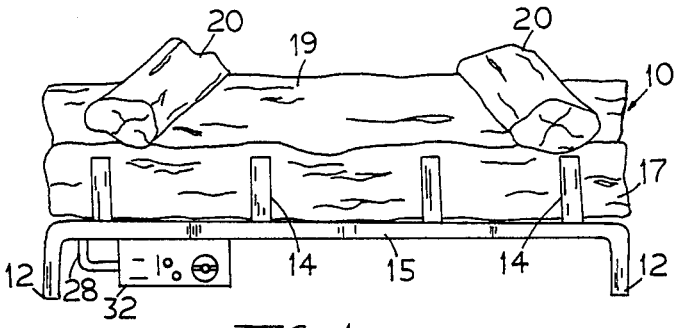
FIG. 1 is a perspective front elevation view of a fireplace gas burner assembly according to the present invention.

Referring now to the drawings wherein like reference numerals designate corresponding parts in the several views, the gas burner assembly 10 has a supporting grate 11 which may be made of cast iron or hot rolled steel bars or formed sheet metal channels welded together. The grate 11 has legs 12, two side bars 13 and a plurality of evenly spaced front abutment rods 14 formed on a cross bar 15. The front abutment rods 14 are bent upwardly to form the front fence of the grate 11. Upwardly extending restraining brackets 16 are provided on the grate 11 in a spaced position behind the front fence such that a front artificial log 17 can be held securely between the front abutment rods 14 and the restraining brackets 16. A slanted and generally S-shaped stand 18 is provided at the rear portion of the grate 11 such that a rear artificial log 19 may be supported in a slightly higher position than the front artificial log 17. Two top logs 20 are placed on the front log 17 and rear log 19 and may be arranged in a non-parallel manner to each other with their rear portion positioned skewed closer to each other than the front portions therein. Such arrangement provides a pleasing appearance and a better front view of the logs in the assembly with the flames flickering among all the logs during operation. If desired, the S-shaped stand may be eliminated and the rear log 19 can be placed directly on the grate at the same level as the front log 17.

Figure 5:
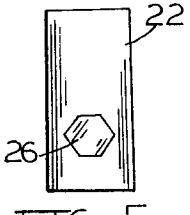
FIG. 5 is a perspective end view of the closed end of the gas burner.
Figure 4:
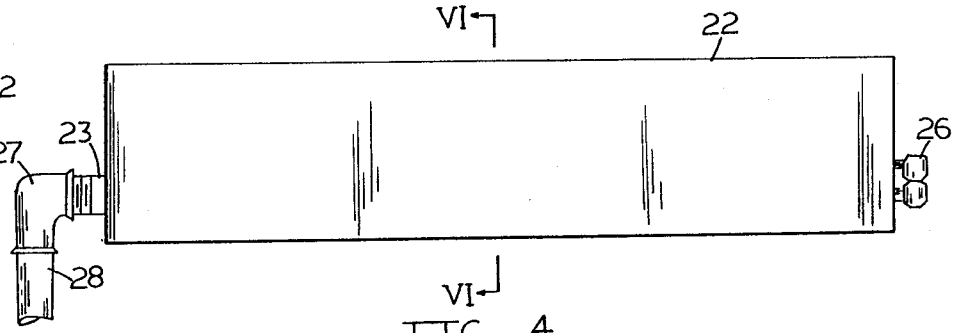
FIG. 4 is a perspective front elevation view of the burner casing according to the present invention.
Figure 6:
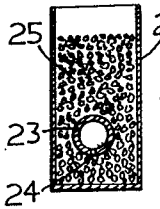
FIG. 6 is a cross section view of the gas burner along line VI—VI in FIG. 5.
Figure 7:
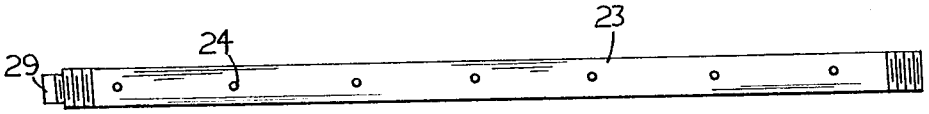
FIG. 7 is a bottom view of the gas pipe in the gas burner.

A gas burner 21 is mounted on the grate 11 and is positioned between the front log 17 and the rear log 19 as best shown in FIGS. 4, 5 and 6. The gas burner 21 consists a rectangular opened top casing 22 and an elongated gas pipe 23 positioned close to but spaced from the bottom of the casing 22. The gas pipe 23 may be cylindrical in shape and has a plurality of openings 24 formed at its bottom portion therein as shown in FIG. 7 to provide the gas outlet ports. The casing 22 is filled with non-combutible granular particles 25 to a level slightly below the upper rim therein. For example, crushed pumice stone having a size of about ⅛ inch to 3/16 inch diameter are suitable or such purpose.

The end portions of the gas pipe 23 extend outwards of the two sides of the casing 22. One end of the gas pipe 23 is closed by a cap 26; the other end is connected to an inverted L-shaped elbow coupler 27 as shown in FIG. 4, which has a downward pointing section for connection to the gas supply tube 28.

An orifice 29 is mounted on the gas inlet end of the gas pipe 23. Alternatively, a T-shaped coupler 27 may be used as shown in FIG. 8. The T-shaped coupler has an opened end opposite to the orifice 29. This opened end is normally closed by a threaded cap 30 which can be removed for ready access of the orifice 29 for servicing or replacement of the latter. The size of the orifice 29 is pre-selected to provide the optimum operation of the gas burner assembly.

A spacing of, for example, typically about 15 mm to 30 mm is provided between the gas burner 21 and the side of the front log 17 and about 15 mm to 50 mm between the gas burner 21 and the rear log 19. Such air spacings provide channels for fresh air to be drawn upwards therethrough during operations of the gas burner 21 to feed the flame and to create the proper gas and air mixture ratio for producing the proper combustion.

Figure 2:
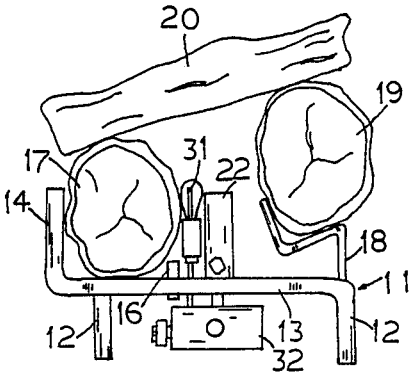
FIG. 2 is a perspective side elevation view thereof.
Figure 3:
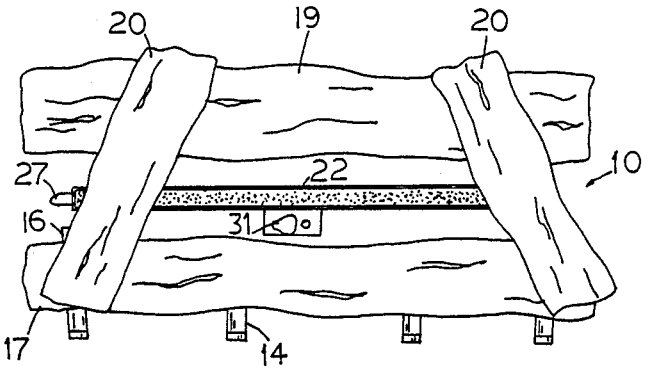
FIG. 3 is a perspective top elevation view thereof.

A pilot lighter 31 can be either mounted on the grate 11 or the side of the burner casing 22 and is positioned adjacent to the top of the casing 22 as best shown in FIG. 2. A control box 32 for the gas supply as well as the pilot lighter 31 may be located in a convenient location under the grate 11 for easy operation by the user.

As shown in FIGS. 9 and 10 the artificial log according to the present invention comprises a metal form base 33 such as an aluminum or other metal flexible tube, covered with a ceramic fibre outer wrap 34 such as cerablanket(trade mark) to form a log form base. After the outer wrap has been placed on, the assembly may be bent or shaped to simulate various shapes of a natural wood log. The ceramic fibre outer wrap is then impregnated with a colloidal solution and thermally cured. Subsequently the thermally cured log form base is coated with a second layer of colloidal outer material and textured and painted to simulate a natural wood log surface. The ends of the log form base are covered with a colloidal cement. The log form is then thermally cured to provide the final thermally stable finish. Such unique ceramic fibre log has the desirable characteristics of fast heat up during use so as to reduce flame impingement, and thus reducing the formation of carbon monoxide gas during operation. Such desirable characteristics will become apparent in the following description. In operation, gas from the gas pipe 23 will be released through the bottom outlet ports 24; the gas will then permeate through the granular particles 25 to rise to the top of the burner casing 22. The gas emitted from the top of of the burner casing 22 will then be ignited by the pilot lighter 31. Due to the random distribution of the gas emitted from the burner casing 22 after it has permeated through the granular particles 25, yellow flames will be formed at the top of the burner casing 22. Such randomly formed yellow flames flickering over the top of the burner casing 22 are similar in appearance to the yellow flickering flames naturally formed in a real wood log fire. Due to the fast heat up characteristics of the ceramic fibre artificial logs the surface of the logs immediately adjacent to the burner will become heated up quickly to a very hot condition by the flames. Such very hot surfaces then tend to repel the flames away therefrom; in the meantime, fresh air is being drawn upwards by the heat to rise up the channels between the logs and the burner, thus the flames will be pushed upwards to the space between the logs and will move slightly above the logs. Such flaming phenomenon is similar to the flame pattern of a rear wood log fire. Furthermore, the constant flow of fresh air upwards in the assembly facilitates very clean burning of the gas with virtually no formation of harmful carbon monoxide gas despite of the production of yellow flames similar to those of the burning of the real wood logs. The clean burning characteristics of the present gas burner assembly may not be erroneously altered by the user since the orifice 29 is pre-set and the amount of gas supply cannot be changed.

Figure 13:
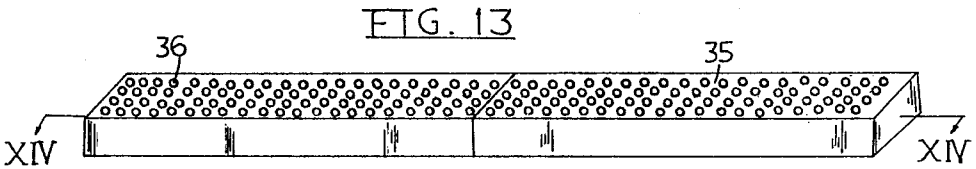
FIG. 13 is a perspective front elevation view of the gas distribution tile according to the present invention.
Figure 14:
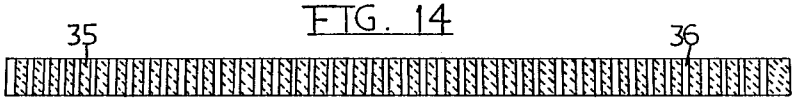
FIG. 14 is a cross section view of the gas distribution tile along line XIV—XIV of FIG. 13.
Figure 11:
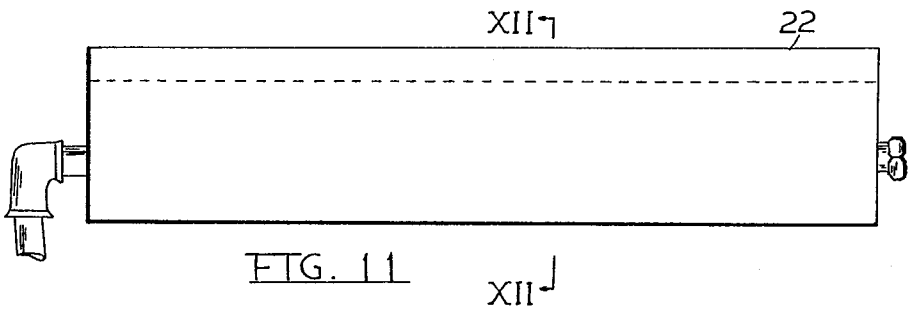
FIG. 11 is a perspective front elevation view of the gas burner alternatively having a gas distribution tile provided instead of granular particles filling the burner casing.
Figure 12:
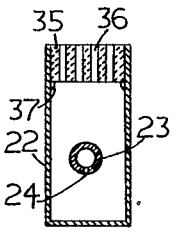
FIG. 12 is a cross section view of the alternative gas burner construction along section line XII—XII of FIG. 11.

As shown in FIGS. 11 and 12, alternatively, instead of filling the burner casing 22 with the granular particles 25, a gas distribution tile 35 may be provided at the top portion of the casing 22. The gas distribution tile 35 is preferrably made of a refractory material such as ceramic. As best shown in FIGS. 13 and 14 the gas distribution tile 35 has a plurality of small vertical through openings 36 forming a honeycomb-like pattern therein. The gas distribution tile 35 has dimensions such that it is snugly fitted at the top portion of the casing 22 and may be retained in position by tabs or protrusions 37 formed on the side walls of the casing 22. The gas distribution tile 35 may also be in two or more sections for ease of removal from the casing 22 for cleaning or replacement purposes. With the use of such gas distribution tile 35 instead of the granular particles filling the casing 22, the gas released from the gas pipe 23 will emit from the top of the burner casing 22 by passing through the openings 36. The resulting flame pattern with such construction is similar to that by filling the casing with the granular particles.

As shown in FIG. 15, two flame deflectors 38 may be additionally provided below the top logs 20 so as to enhance the flame pattern. Each deflectors 38 may be made of stainless steel. The deflector 38 consists of a generally v-shaped body having two sloping panels 39 and 40 mounted on a U-shaped bracket 41 which has two upstanding arms 42 and two downwardly extending legs 43. The deflectors 38 can be mounted to the burner casing 22 by securing the legs 43 to the casing 22. The length of the sloping panels 39 and 40 is equal to or less than the distance between the front log 17 and the rear log 19, so that the deflectors can be located between the front and rear logs and are positioned in a spaced manner below the underside and most of the lateral sides of the top logs to shield these areas from the casing 22. Two openings may be formed at the underside of the top logs 20 which can be engaged with the two upstanding arms 42 of the brackets 41 of the deflectors for ease in locating the top logs properly in the burner assembly.

The deflectors 38 baffle the top logs 20 from direct impingement by the hot flame, such that the flame will rise up higher above the logs in the burner assembly to produce higher yellow flames. The flame deflector panels may be provided in various selected angles relative to the horizontal plane so as to obtain flames of various heights. FIGS. 20 and 21 show a flame deflector construction in which the base of the deflector has two slightly sloping base portions 45 and 46 and the panels 47 and 48 are positioned vertically. Such flame deflector with vertical panels produces the highest flames in the assembly.

FIGS. 22 through 27 show an alternative burner construction. In this construction, the gas pipe 23 is replaced by a fuel mixture chamber 49 formed in the casing 22 by snug-fitting a U-shaped cross section differential cover 50 at the bottom portion of the casing 22. A plurality of small transfer openings 51 are formed at the top panel 52 of the cover 50. Typically ten transfer openings divided in three groups as best shown in FIG. 24 are sufficient. The three groups of openings are located below the spacing between the top logs 20 and the sides of these top logs. A cantilever air guide panel 53 is provided in the differential cover 50. The air guide panel 53 has one end secured to the top panel 52 at the end immediately adjacent to the orifice 29 and slopes downwardly to a short flat bottom portion 54 which is positioned slightly above the bottom of the casing 22 thus forming a narrow gap 55 between the flat bottom portion 54 and the bottom of the casing 22. The air guide panel 53 has a width same as the inside width of the differential cover 50. A fresh air opening 56 is formed at the bottom of the casing 22 adjacent to the orifice 29, or alternatively instead of forming the fresh air opening 56 at the bottom of the casing 22, expanded openings may be provided around the mounting opening for the orifice 29 formed at the end panel of the casing 22 to provide the fresh air inlet. In operation, the gas entering the burner through the orifice 29 is forced downwards following the sloping air guide panel 53 to pass through the narrow gap 55 to enter into the fuel mixture chamber 49. The passing of the gas through the narrow gap 55 creates a venturi effect therein to draw an amount of fresh air into the casing 22 through the fresh air opening 56, thus forming a desirable air and gas mixture in the fuel mixture chamber 49. The air and gas mixture then passes through the transfer openings 51 into the upper chamber 57 and subsequently emits to the top of the burner casing 22 through the through openings 36 of the distribution tile 17 to be ignited by the pilot lighter. Due to the introduction of additional fresh air into the combustible fuel mixture, blue flames will formed at a level below the yellow flames upon burning. However, the blue flames are normally concealed from view by the front log 17. The additional fresh air renders the ignition of the fuel mixture to burn even more cleanly with practically no formation of carbon monoxide gas.

Also, instead of using the flame deflectors 38 above the burner casing, the desirable flame pattern rising to a high level above the logs may alternatively be obtained by incorporating gas baffle inserts 58 into the gas burner casing 22 as shown in FIGS. 28 through 31. The baffle inserts are located on the top panel 52 of the differential cover 50 in the areas between the three groups of transfer openings 51. The baffle inserts 58 have a generally inverted V-shaped cross section having a gable top 59 with a ridge 60 extending the entire longitudinal length of the differential cover 50, and two substantially parallel vertical downwardly skirting lateral sides 61. The length of the baffle inserts 58 is approximately equal to the diameter of the top logs 20. The two baffle inserts 58 are located in the upper chamber 57 and are secured in place by sandwiching between the differential cover 50 and the distribution tile 35.

The burner casing may be provided in various configurations as shown in FIGS. 32 and 33 to form burner assemblies for use in different types of fireplaces. The rectangular configuration as shown in FIG. 32 can be used for an opened fireplace in which all sides of the fireplace are opened to view. Logs may be arranged around such rectangular burner casing to offer log assemblies and flame patterns visible in all sides of the fireplace.

The L-shaped configuration of burner casing shown in FIG. 33 is suitable for use in a fireplace located in a corner of a room. Such corner fireplace has two opened sides. The L-shaped burner casing allows logs to be arranged around it to provide log assemblies and flame patterns that are fully visible in both opened sides of the corner fireplace.

I claim:

1. In a fireplace gas burner assembly, a burner means comprising, a substantially rectangular casing, said casing having an opened top, a differential cover means disposed in said casing and dividing said casing into an upper portion and a lower portion, said lower portion being operative as a fuel mixing chamber, an orifice means mounted at one end of said casing and in communication with said fuel mixing chamber, fresh air inlet means formed in said casing and located immediately adjacent to said orifice means, a plurality of small transfer openings formed in said differential cover means and operative to pass gas and air mixture from said fuel mixing chamber to said upper portion of of said casing, an air guide panel means having one end secured in a cantilever manner to said differential cover means at one end therein immediately adjacent to said orifice means and extending slopingly downwardly in said fuel mixing chamber to a flat portion disposed in a closed spaced manner to the bottom panel of said casing to form a narrow air gap adjacent to said fresh air inlet means, gas distribution tile means located in said upper portion of said casing, said distribution tile means having a plurality of vertical through openings formed therein communicating between said upper portion of said casing and said opening top.

2. A fireplace gas burner means according to claim 1 wherein said fresh air inlet means are openings formed at the end panel of said casing and located around said orifice means.

3. A fireplace gas burner means according to claim 1 wherein said fresh air inlet means is an opening formed at the bottom panel of said casing.

4. A fireplace gas burner means according to claim 2 including at least two gas baffle insert means located between said differential cover means and said gas distribution tile means, said gas baffle insert means having an inverted V-shaped cross section and a gable top with a ridge extending throughout the entire longitudinal length therein, and two downwardly skirting lateral sides.

5. A fireplace gas burner assembly comprising, a grate means, a burner means mounted on said grate means, said burner means comprising, a substantially rectangular casing having an opened top and closed sides, a differential cover means mounted inside said casing and dividing the interior of said casing into an upper portion and a lower portion, said lower portion being operative as a fuel mixing chamber, an orifice means mounted at one end of said casing and in communication with said fuel mixing chamber, a plurality of small transfer openings formed in said differential cover means and operative to pass gas and air mixture from said fuel mixing chamber to said upper portion of said casing, an air guide panel means mounted in a cantilever manner to the underside of said differential cover means and extending slopingly downwardly in said fuel mixing chamber to a flat portion disposed in a close spaced manner to the bottom panel of said casing, fresh air inlet means formed in said casing, and located immediately adjacent to said orifice means, two baffle insert means having an inverted V-shaped cross section with a gable top including a ridge extending along the entire longitudinal length therein and two downwardly extending and mutually parallel skirting lateral side panels , distribution tile means located in said upper portion of said casing, said distribution tile means having a pluraity of vertical through openings, a coupler means mounted to said orifice means and operative for connection to a combustible gas supply, a first artificial log member disposed on said grate means and located in a spaced relation to a front side of said burner means, a second artificial log member disposed on said grate means and located in a spaced relation to a rear side of said burner means, a pilot lighter means mounted to said grate means and operative to ignite the gas and air mixiture emitting to the top of said casing through said through openings of said distribution tile means, control means mounted under said grate means and connected to said coupler means and operative to control the supply of said combustible gas to said burner means and said pilot lighter means.

6. A fireplace gas burner assembly according to claim 5 including two flame deflector means mounted to said casing, said flame deflector means having at least two panels disposed in a spaced manner below said artificial top log member.

7. A fireplace gas burner assembly according to claim 6 wherein said flame deflector means are mounted to said casing by a mounting bracket, and said panels slope outwardly and upwardly from said mounting bracket.

8. A fireplace gas burner assembly according to claim 7 wherein said flame deflector means are mounted to said casing by a mounting bracket, and said panels include gently sloping base portions mounted to said mounting bracket, and substantially vertical portions extending upwardly and substantially vertically from the free end of said base portions.

9. A fireplace gas burner assembly according to claim 8 wherein said flame deflector means include two vertical arm means extending upwardly from said mounting bracket and operative to engage with two associated mounting openings formed at the underside of said artificial top log member.

10. A fireplace gas burner assembly according to claim 5 wherein said fresh air inlet means are openings formed on a side wall of said casing.

11. An artificial log comprising an elongated flexible integral section of aluminum tubular member, a ceramic fibre sheet member wrapping over said aluminum tubular member, said ceramic fibre sheet member being impregnated with a thermally set colloidal compound and thermally cured, a second layer of thermally set colloidal compound disposed over said colloidal impregnated ceramic fibre sheet member, said second layer of colloidal compound being textured, painted and thermally cured to simulate a natural wood surface.

* * * * *